US006871793B2

(12) United States Patent
Rumens et al.

(10) Patent No.: US 6,871,793 B2
(45) Date of Patent: Mar. 29, 2005

(54) FIRE AND WATER DISPLAY DEVICE

(75) Inventors: Kurt W. F. Rumens, Kirkland, WA (US); Alan Atemboski, Renton, WA (US); Homer Lee, Vancouver (CA)

(73) Assignee: Travis Industries, Inc., Mukilteo, WA (US)

( * ) Notice: Subject to any disclaimer, the term of this patent is extended or adjusted under 35 U.S.C. 154(b) by 0 days.

(21) Appl. No.: 10/407,283

(22) Filed: Apr. 3, 2003

(65) Prior Publication Data

US 2003/0201336 A1 Oct. 30, 2003

Related U.S. Application Data

(60) Provisional application No. 60/371,615, filed on Apr. 10, 2002.

(51) Int. Cl.[7] ..... E03B 9/20

(52) U.S. Cl. ..... 239/16; 239/17; 239/18

(58) Field of Search ..... 239/16, 17, 18, 239/20, 22, 23

(56) References Cited

U.S. PATENT DOCUMENTS

| | | | | | |
|---|---|---|---|---|---|
| 152,782 | A | * | 7/1874 | Wenck | 239/22 |
| 179,977 | A | * | 7/1876 | Turrettini | 239/22 |
| 221,931 | A | * | 11/1879 | Stabler | 119/843 |
| 3,038,064 | A | | 6/1962 | Gieb | |
| 3,565,337 | A | | 2/1971 | Ditto | |
| 3,589,789 | A | * | 6/1971 | Hubert et al. | 445/24 |
| 3,722,816 | A | * | 3/1973 | Stewart et al. | 239/17 |
| 3,785,559 | A | * | 1/1974 | Hruby et al. | 239/17 |
| 3,838,816 | A | * | 10/1974 | Huff et al. | 239/18 |
| 4,083,331 | A | * | 4/1978 | Guenther | 123/41.17 |
| 4,379,525 | A | * | 4/1983 | Nowicki et al. | 241/20 |
| 4,858,826 | A | | 8/1989 | Robinson et al. | |
| 5,092,312 | A | | 3/1992 | Zolow | |
| 5,961,042 | A | * | 10/1999 | Doyle | 239/12 |
| 6,131,819 | A | * | 10/2000 | Fuller et al. | 239/20 |
| 2003/0113677 | A1 | * | 6/2003 | Doud | 431/77 |

FOREIGN PATENT DOCUMENTS

| | | | |
|---|---|---|---|
| DE | 242418 | | 8/1910 |
| EP | 0 953 799 | | 11/1999 |
| FR | 2662491 | | 11/1991 |
| JP | 02098002 | | 4/1999 |
| JP | 411216294 A | * | 8/1999 |

* cited by examiner

*Primary Examiner*—William E. Tapolcai
*Assistant Examiner*—Mohammad M. Ali
(74) *Attorney, Agent, or Firm*—Perkins Coie LLP

(57) ABSTRACT

A device for the ornamental display of the interaction of fire and water allowing the spray of a water fountain to be combined with flame from a gas burner is described. The device includes one or more gas burners configured amongst one or more water dispersion assemblies. The water streams from the nozzles of the water dispersion assemblies of the fountain can be directed toward, through, and over the flames originating from the gas burners. The flames originating burners are protected from being extinguished by a water shield. The water shield is positioned in such a manner to influence the characteristics of the flame produced by the burner while still protecting the flames' integrity. The water and fire aspect of the device can operate independently providing a fire source with a reflecting pool or a water fountain absent the flames.

38 Claims, 7 Drawing Sheets

FIRE AND WATER DISPLAY DEVICE

CROSS REFERENCE TO RELATED APPLICATIONS

This application claims the benefit of U.S. Provisional Application No. 60/371,615, filed Apr. 10, 2002 to which a claim for priority is made.

TECHNICAL FIELD

The following disclosure relates generally to fountains and, more particularly, to water fountains that include a gas-fired flame.

BACKGROUND

Water fountains and devices displaying fire have long been treasured individually for their decorative and entertaining qualities. Fountains ranging in size from a small desktop display with a trickle of water to a large sculpted work of art spraying hundreds of gallons of water have been admired and sought after for hundreds of years. Likewise, the captivating and artistic nature of fire in the form of the home fireplace, an outdoor fire pit, or even the group bonfire has long been a central part of modern décor long after the functional values of such devices where superseded by technology.

The contrast between fire and water could not be more apparent and their combination has often been used in artistic renderings. The effective introduction of fire to a water fountain is not, however, a simple task and has long remained a technical challenge. Previous attempts to display fire and water in the same device have been attained by limiting or preventing any interaction between the flames and water. Normally, any apparent interaction of the two elements is through creative designs capitalizing on an observer's lack of depth perception to seemingly show that the flames and streams of water are interacting when in reality they are completely separate. One example of such a device is a fireplace and water fountain combination described in U.S. Pat. No. 5,092,312. While such illusions can be very intricate, they remain illusions that cannot display the true effects of a fountain's water interacting with a ring of fire.

BRIEF DESCRIPTION OF THE DRAWINGS

In the drawings, the same reference numbers identify identical or substantially similar elements.

DETAILED DESCRIPTION OF THE ILLUSTRATED EMBODIMENT

A display device having a water fountain with streams of water interacting with fire in accordance with embodiments of the present invention are disclosed and shown in FIGS. 1–6. The display device disclosed combines the artistic nature and qualities of a water fountain and fire source in one apparatus. In the following description, for purposes of explanation, numerous details are set forth, such as specific materials, arrangements, and proportions in order to provide a thorough understanding of the present device. It will be apparent to those skilled in the relevant art that the device disclosed may be practiced without these specific details. Furthermore, well-known structures or operations are not shown, or are not described in detail, to avoid obscuring aspects of the invention.

The following discussion provides a general overview of the orientation and structure of the fire and water fountain and then presents a more detailed discussion of the gas distribution and water dispersion assemblies. Throughout this disclosure, alternate embodiments of the device are presented to display the robust nature of the device. In general, alternatives and alternative embodiments described herein are substantially similar to previously described embodiments, and common elements and functions are identified by the same reference numbers. Only significant differences in construction or operation are described in detail.

Figure 1:
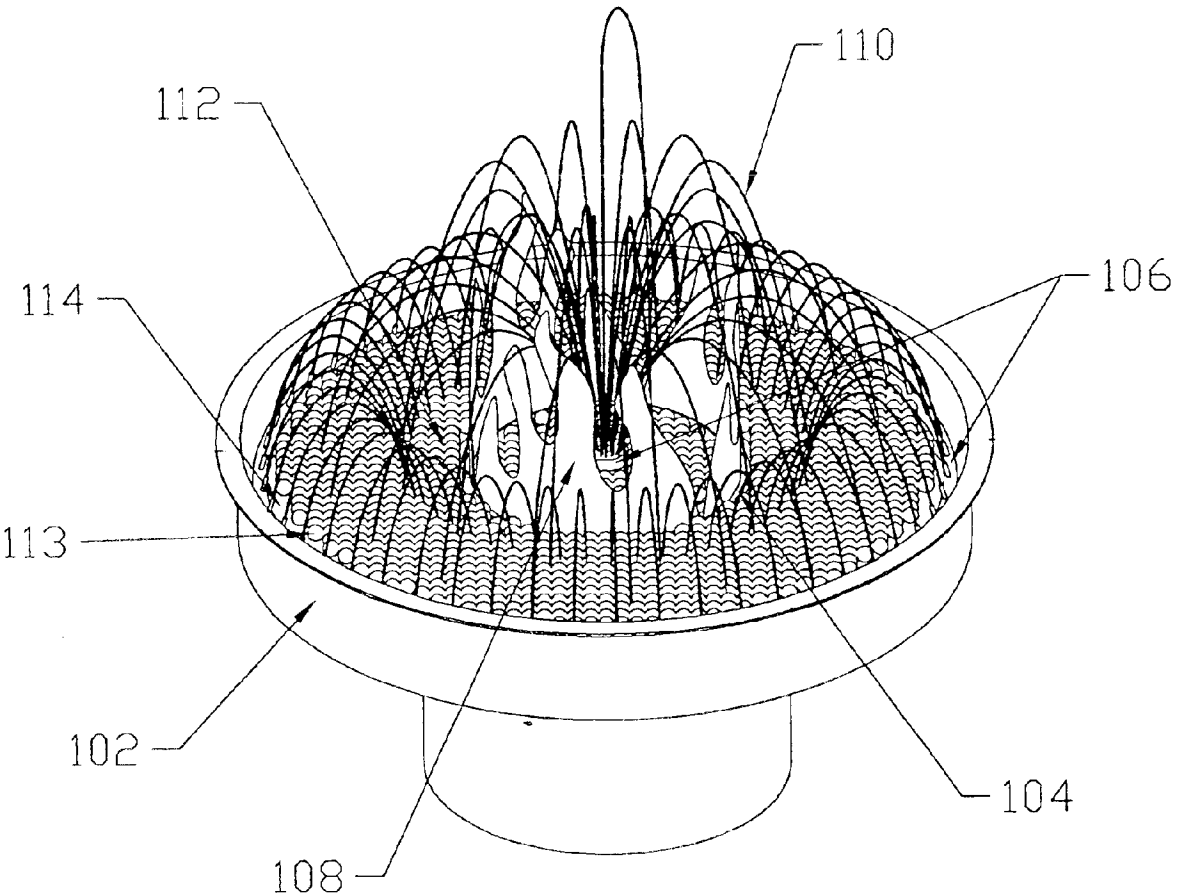
FIG. 1 is a display device showing the interaction of fire and water under one embodiment of the claimed invention.
Figure 2:
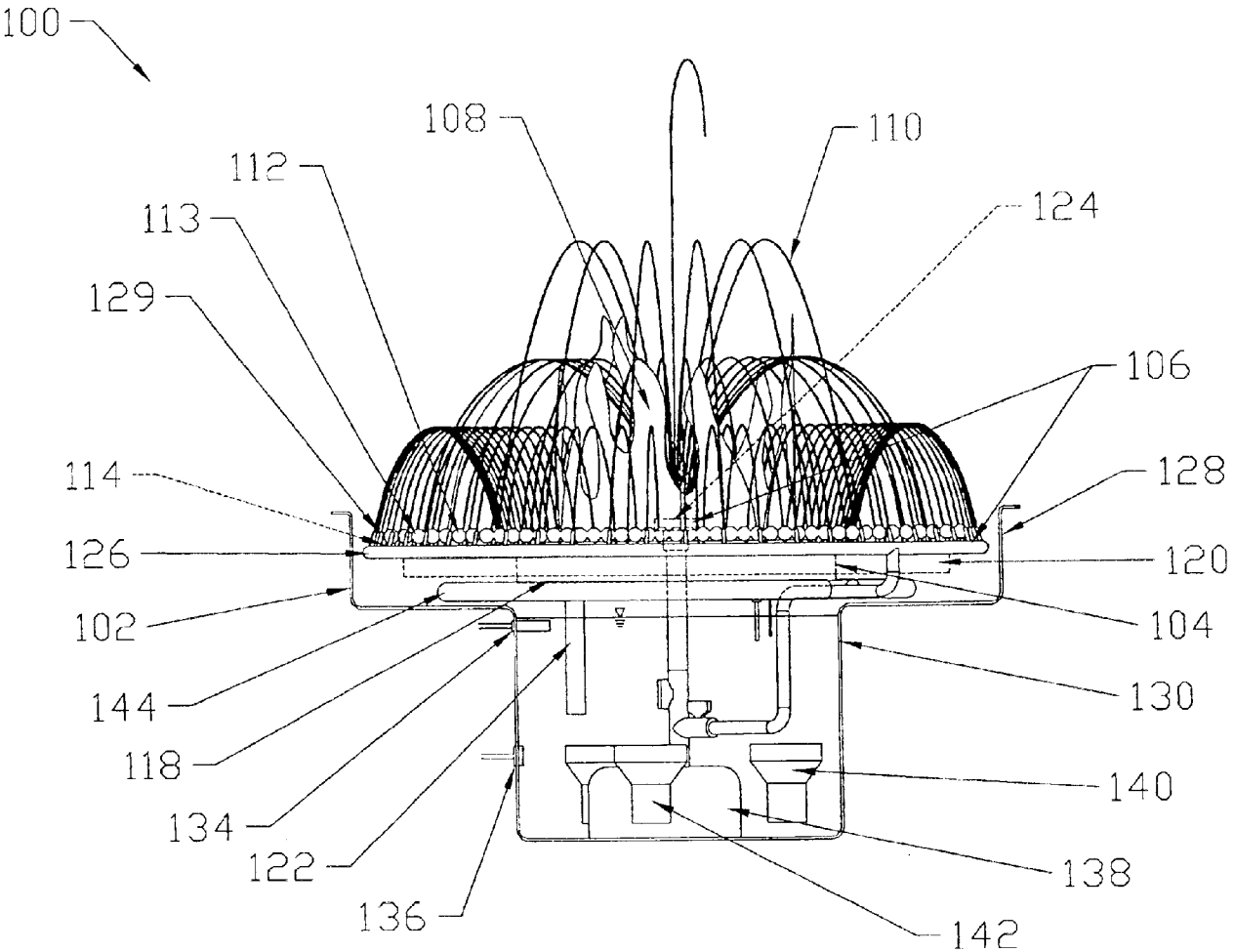
FIG. 2 is a partial side elevation view of the display device of FIG. 1, a side portion of the reservoir not shown for purposes of clarity.

FIG. 1 shows one embodiment of a fire and water display device 100 exhibiting the interaction of fire and water in a fountain setting. FIG. 2 shows a partial side elevation view of the fire and water display device 100 of FIG. 1, with a portion of the reservoir 102 not shown for purposes of clarity. The fire and water display device 100 in this embodiment includes a reservoir 102, a gas distribution assembly 104, and a water dispersion assembly 106. From the gas distribution assembly 104, flames 108 can be produced possessing a variety of artistic and aesthetic characteristics. Likewise, the water dispersion assembly 106 can emit streams of water 110 in a variety of formats, consistencies, and directions to intersect with the flames 108 to produce a unique interaction of fire and water above the reservoir 102.

The streams of water 110 terminate on top of a bed of anti-splatter aggregates 112, which is supported by a retaining grate assembly 114. In this illustrated embodiment, the bed of anti-splatter aggregates 112 consist of numerous small transparent glass spheres 113 removably supported on a grate assembly 114 in the reservoir 102. The spheres 113 provide non-planar surfaces for termination of the streams of water 110 that reduce the splattering of water when the streams of water 110 land in the reservoir. The anti-splatter aggregates 112 can be made of other materials, such as stone or any suitable water-resistant material or may have different geometric shapes, sizes and optical characteristics. The grate assembly 114 supports the anti-splatter aggregates 112 at a fix distance relative to the bottom of the reservoir 102. The grate assembly 114 is perforated to allow water to drain through to the reservoir, yet the perforations are smaller then the aggregates to prevent them from falling in. The grate assembly 114 also has a plurality of generally annular cutouts positioned and sized to receive the gas distribution assemblies 104 and the water dispersion assemblies 106.

Figure 3:
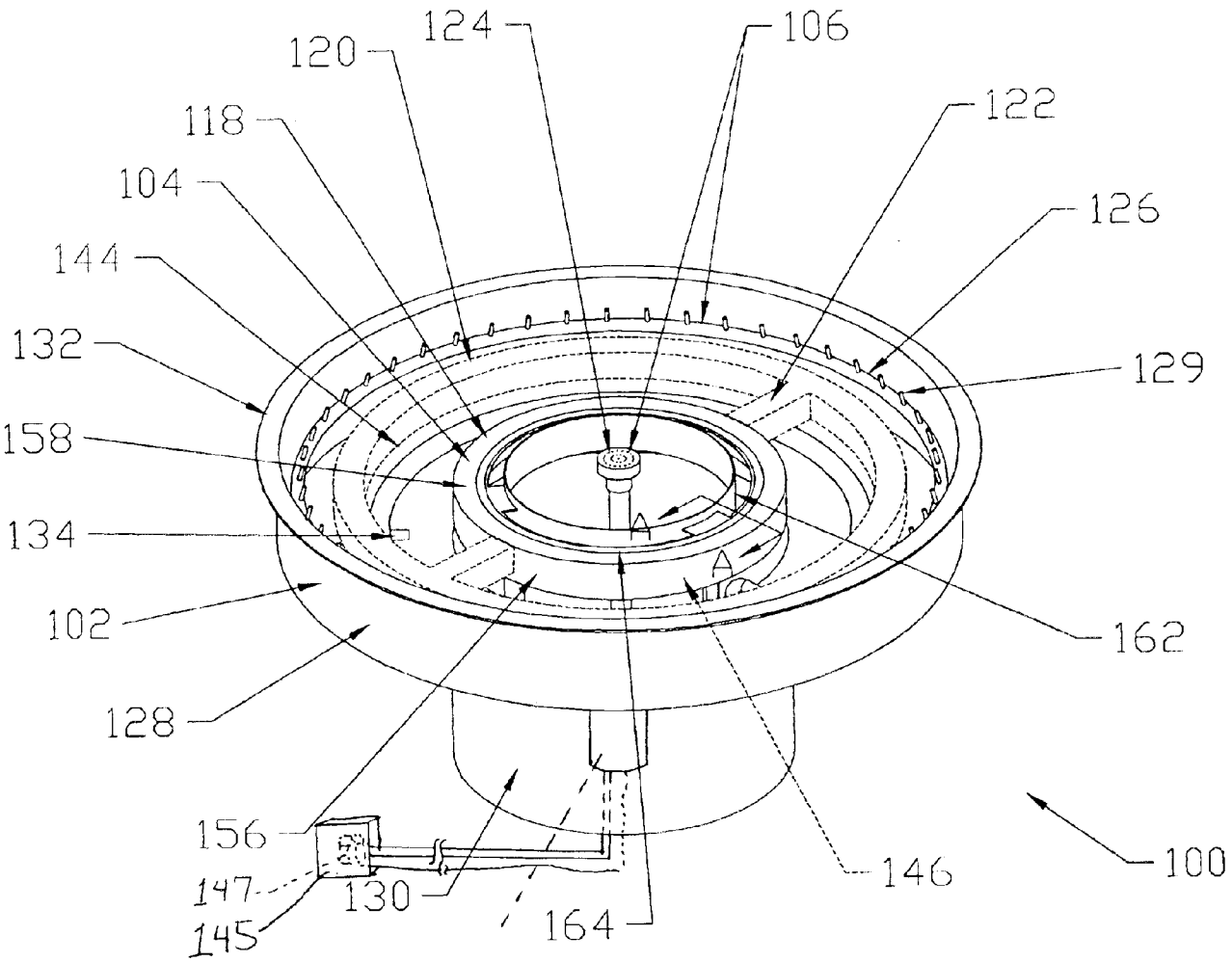
FIG. 3 is an isometric view of a portion of the display device of FIG. 1, the water, flames, and anti-splatter aggregate bed and retaining grate not shown for purposes of clarity.

FIG. 3 is an isometric view of a portion of the display device of FIG. 1, the water, flames, and anti-splatter aggregate bed and retaining grate not shown for purposes of clarity. In this illustrated embodiment, the gas distribution assembly 104 includes two gas conduits 118, 120 configured as concentric rings. In other embodiments, the gas conduits 118, 120 can be a variety of shapes, sizes, and orientations, including semicircles, ovals, rectangles and straight segments. In other embodiments, a single gas conduit can be used, or three or more gas conduits can be used. The gas conduits 118, 120 as illustrated are coupled by a gas manifold 122 that can act as both a structural support and a chamber where the distribution of the flammable gas can be controlled. The gas manifold is fluidly connected to a gas source so as to direct a selected flammable gas (such as natural gas, propane, etc.) from the gas source to the gas conduits 118, 120.

In the illustrated embodiment, the inner gas conduit 118 is configured to direct the flame 108 (FIG. 2) generally radially inwardly and upwardly. Positioned geometrically in the center of the inner gas conduit 118 is a water dispersion assembly 106 configured as a central water nozzle 124. The central water nozzle 124 is configured in this embodiment to direct a number of streams of water 110 (FIG. 2) upwardly and in a symmetrical outwardly divergent circular pattern. Accordingly, the streams of water 110 and the flames 108 are directed generally toward each other so that the water and flames actually intersect and interact at an elevated position, such as above the reservoir 102 (FIGS. 1 and 2). As with the gas conduits 118, 120, the actual orientation and configuration of the central water nozzle 124 can vary to meet the artistic and aesthetic goals of the fire and water display device 100.

The fire and water display device 100 shown in FIGS. 2 and 3 also include a second water dispersion assembly 106 configured in a ring orientation. In this embodiment, the second water dispersion assembly 106 is an outer water ring 126 positioned in an upper basin 128 of the reservoir 102 and positioned radially outward from the outer gas conduit 120. The outer water ring 126 can include numerous water nozzles 129 configured to direct streams of water 110 (FIG. 2) radially inwardly toward the center of the fire and water display device 100. The outer water ring 126 in the illustrated embodiment is configured to direct the streams of water 110 upwardly and radially inwardly so as to flow in an arcuate path over the outer gas conduit 120. The outer gas conduit 120 is also configured to direct the flames 108 radially outwardly toward the outer water ring 126. Accordingly, when the flames 108 extend upwardly, the flames actually intersect the streams of water 110 from the outer water ring 126 at a position above the reservoir 102. Although the outer ring 126 is illustrated and discussed as a circular water dispersion assembly 106 in this embodiment, the second water dispersion assembly 106 in alternate embodiments can have other curved or straight shapes. The direction of the streams of water 110 from either the central water nozzle 124 or the outer water ring 126 can be directed to intersect and interact with the flames 108 emanating from the gas conduits 118, 120.

Figure 4:
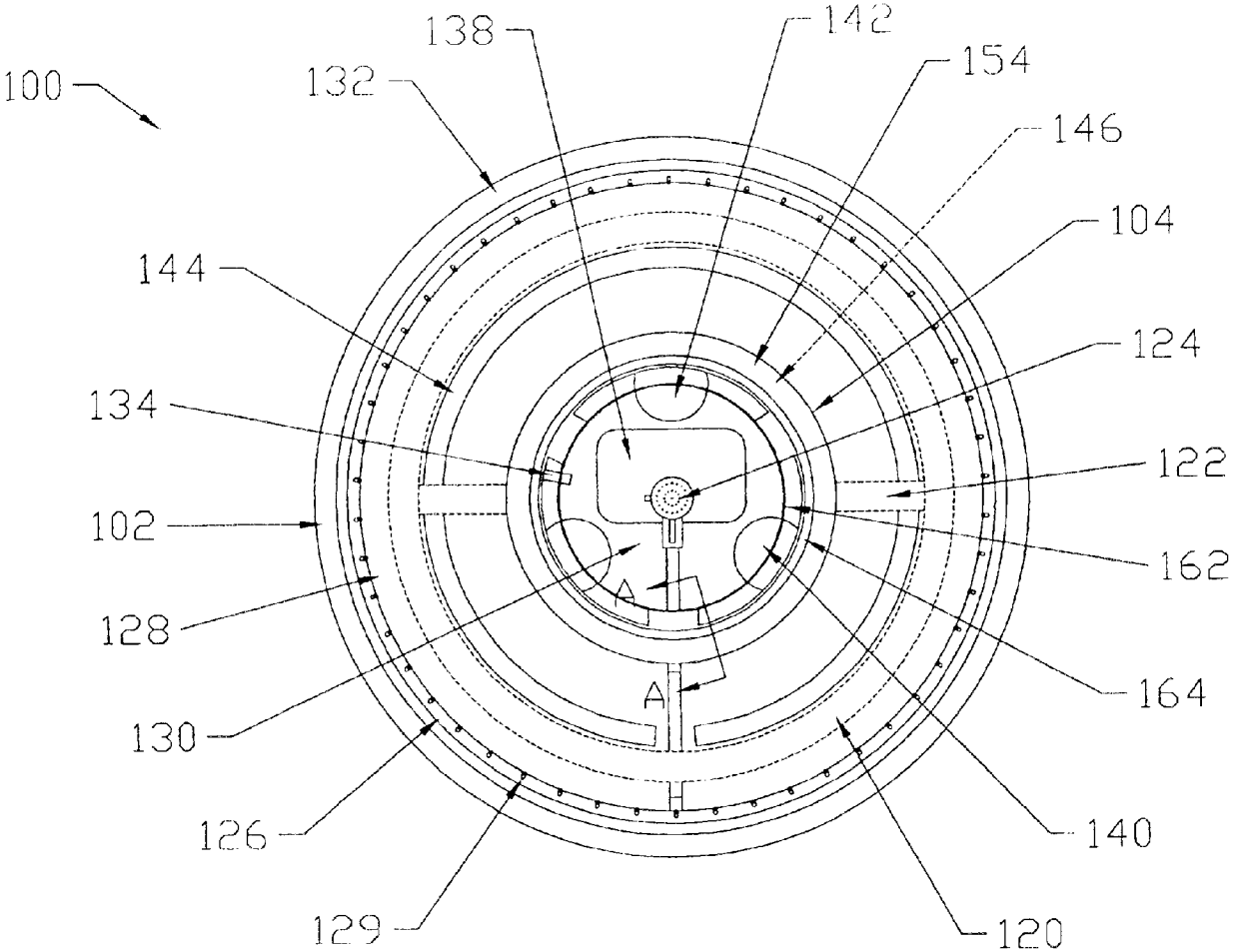
FIG. 4 is a top plan view of the display device of FIG. 1 with the water drained from the reservoir and the display device inactive.
Figure 5:
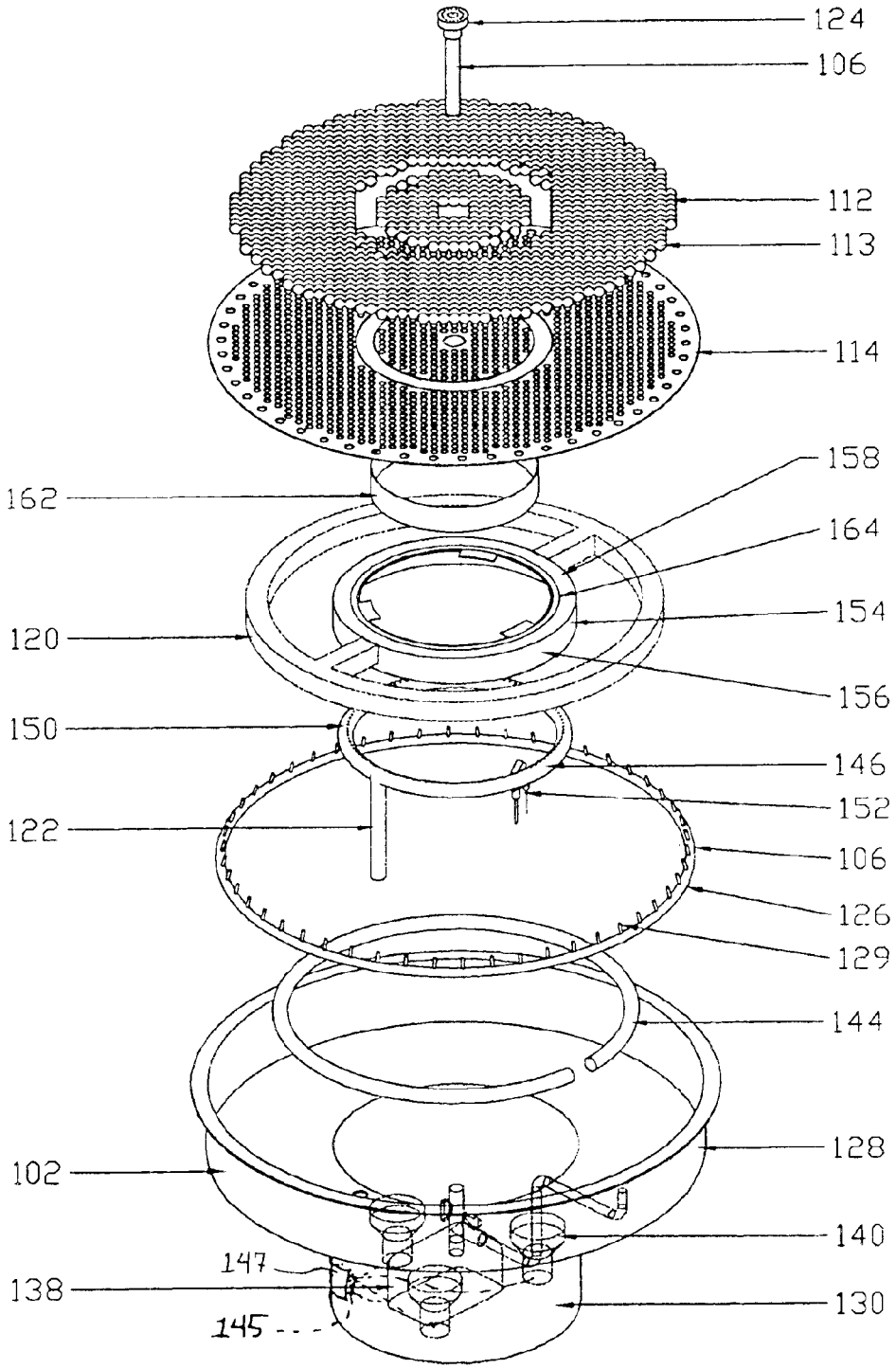
FIG. 5 is an exploded view of the fire and water display device of FIG. 1.

FIG. 4 is a top plan view of the display device 100 of FIG. 1 with the water drained from the reservoir 102. FIG. 5 is an exploded view of the fire and water display device 100 of FIG. 1. The reservoir 102 in this embodiment is configured in an inverted tiered circular orientation with a central well 130 and the upper basin 128. The reservoir 102 is fabricated using a materials and construction technique known in the art so as to be substantially watertight. While the embodiment shown is configured to be a freestanding display, other embodiments can be installed into existing structures or be in-ground versions. Materials used in the fabrication can include stainless steel, fiberglass, plastics, composites, concrete, and other materials commonly used in fountain construction.

The top lip 132 of the upper basin 128 is at a level above the water dispersion assemblies 106 and the gas distribution assemblies 104 of the illustrated embodiment. The water level is controlled via a water level sensor 134 positioned in the upper basin 128 such that the water level does not exceed the upper surface of the gas distribution assembly 104 or the water dispersion assemblies 106. Also, a water temperature sensor 136 (FIG. 5) can be mounted in the central well 130 to ensure that the water temperature remains within reasonable limits.

The central well 130, in this embodiment, is of sufficient size to house a submersible pump 138 and lighting fixtures 140. The pump 138 is fluidly coupled to the water dispersion assemblies 106 such that water from the central well 130 is pumped to and dispensed through either the central water nozzle 124 or the outer water ring 126. The dispensed water can be collected via the upper basin 128 and directed back to the central well 130 for reuse and conservation. In alternate embodiments, a nonsubmersible pump can be located remotely from the reservoir 102 and configured to selectively pump water from the central well 130 to the water dispersion assemblies 106. In configurations that include more than one water dispersion assembly 106, a selector valve can be coupled to the output of the pump 138 to selectively direct the water to one or a combination of the water dispersion assemblies 106. Accordingly, a user can control fountain operation and the water distribution from the water dispersion assemblies 106. The pump 138 can also be manually or automatically controlled to adjust the size of the trajectory of the water streams 110. Water flow from the pump 138 can also be turned off or activated at selected time intervals so the display device 100 can act as a source of flames alone, with the water in the upper basin acting as a reflecting pool. Similarly, the gas flow through the gas distribution assemblies 104 to control flame size relative to the streams of water, or to temporarily turn off the flames so the display device 100 acts as fountain without the flames. Activation of the gas flow can also be controlled for creation of the flames at selected times and in selected patterns to interact with the streams of water 110 (FIGS. 1 and 2).

In one embodiment, a lighting fixture 140 includes a plurality of submersible lamps 142 are provided in the central well 138, and a submersible annular light assembly 144 is provided in the upper basin 128. The lamps 142 and the annular light assembly 144 are aimed upwardly to enhance the esthetic effectiveness of the interaction between the fire and the water streams 110 (FIG. 2). The light from the lamps 142 and the annular light assembly 144 is refracted, reflected and disbursed through the anti-splatter aggregates 112 and the perforated retaining grate 114. The light can also be selectively modified by providing colored lenses on the light fixtures 140 or by providing colored bulbs in the fixtures.

Control devices 145, coupled to the pump 138, the lighting fixtures 140, and to gas control valves are provided in a control housing 147 adjacent to the reservoir 102. The control devices 145 in one embodiment can be controlled at the control housing, or they can be controlled from a control at a location remote from the control housing. The remote controls can be hard-wired to the control devices, or they can be wireless controls using conventional wireless controls.

In another embodiment, the control devices 145 are remotely located from the reservoir 102 and are coupled to the pump 138, lighting fixtures 140, and/or gas control valves by electrical and/or gas conduits. Accordingly, the fire and water display device 100 can be located in one location, such as a yard, foyer, lobby, atrium, etc., and the control devices 145 can be provided at an easily accessible, remote location. These remotely located control devices can also be operated by hard-wired controls or wireless controls.

Figure 6:
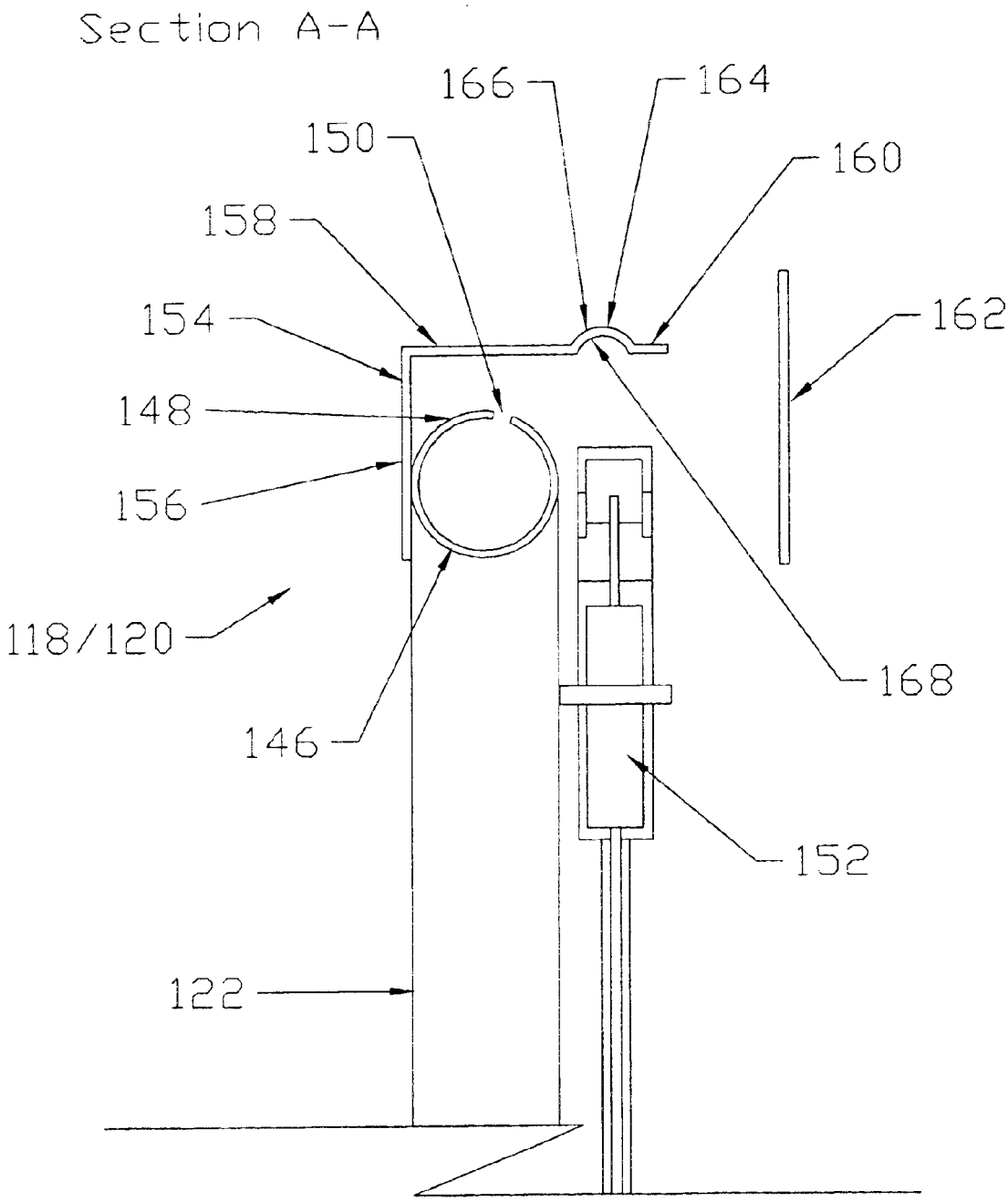
FIG. 6 is a partial cutaway view of one embodiment of a flame assembly for a fire and water display device.

FIG. 6 is a partial cutaway view of an embodiment of a gas distribution assembly 104 for the fire and water display device 100. The gas distribution assembly 104 can include a gas conduit 146 coupled to the gas manifold 122 to receive the flow of combustible gas. The gas conduit 146 is configured to direct the flammable gas substantially uniformly through the gas distribution assembly 104. The gas manifold 122 can also include a valve that allows a user to selectively choose to which gas conduit 146 the gas will be directed when multiple gas conduits are used.

The gas conduit 146 shown in FIG. 6 is a tubular conduit supported a selected distance above the bottom of the upper basin 128. The gas conduit 146 can have different shapes, such as a rectangular conduit or other suitable shape such that the functionality of the gas distribution assembly 104 is retained. In the embodiment shown, the upper portion 148 of the gas conduit 146 includes an aperture 150 for the controlled release of gas from the gas conduit. The size and shape of the aperture 150 can be selected for a desired gas flow therethrough, which helps control the resulting flame characteristics.

Located in proximity to the aperture 150 is an igniter assembly 152 positioned to ignite the flammable gas just after the gas has exited the aperture and is adjacent to the conduit's upper surface. One or more igniter assemblies 152 can be associated with each gas conduit 118, 120 to ensure proper and adequate ignition of the flammable gas upon release through all of the aperture 150. The igniter assembly 152 can be automated or can be manually operated.

In the illustrated embodiment, a water shield 154 is coupled to the gas conduit 146. The water shield 154 generally has an inverted "L"-shaped cross-section formed by a vertical leg 156 and a horizontal leg 158. The vertical leg 156 is positioned adjacent to the side of the gas conduit 146 so that the horizontal leg 158 is spaced above the gas conduit. The gas flowing from the gas conduit's apertures 150 is ignited by igniter assembly 152 while the gas is below the water shield's horizontal leg 158 and in the space above the gas conduit 146. The space between the water shield 150 and the apertures 150 allows the gas being released from the gas conduit 146 to mix with ambient air to provide a selected air-to-fuel mixture for ignition. By controlling the dimensions of this space, different gas-air mixtures can be achieved that, in turn, modify the characteristics of the resulting flames 108 (FIG. 2).

The horizontal leg 158 is positioned away from the apertures 150 to avoid interference with the flow of gas through the apertures. The space between the water shield's horizontal leg 158 and the aperture 150 can be controlled when securing the vertical leg 156 adjacent to the gas conduit 146.

Figure 7:
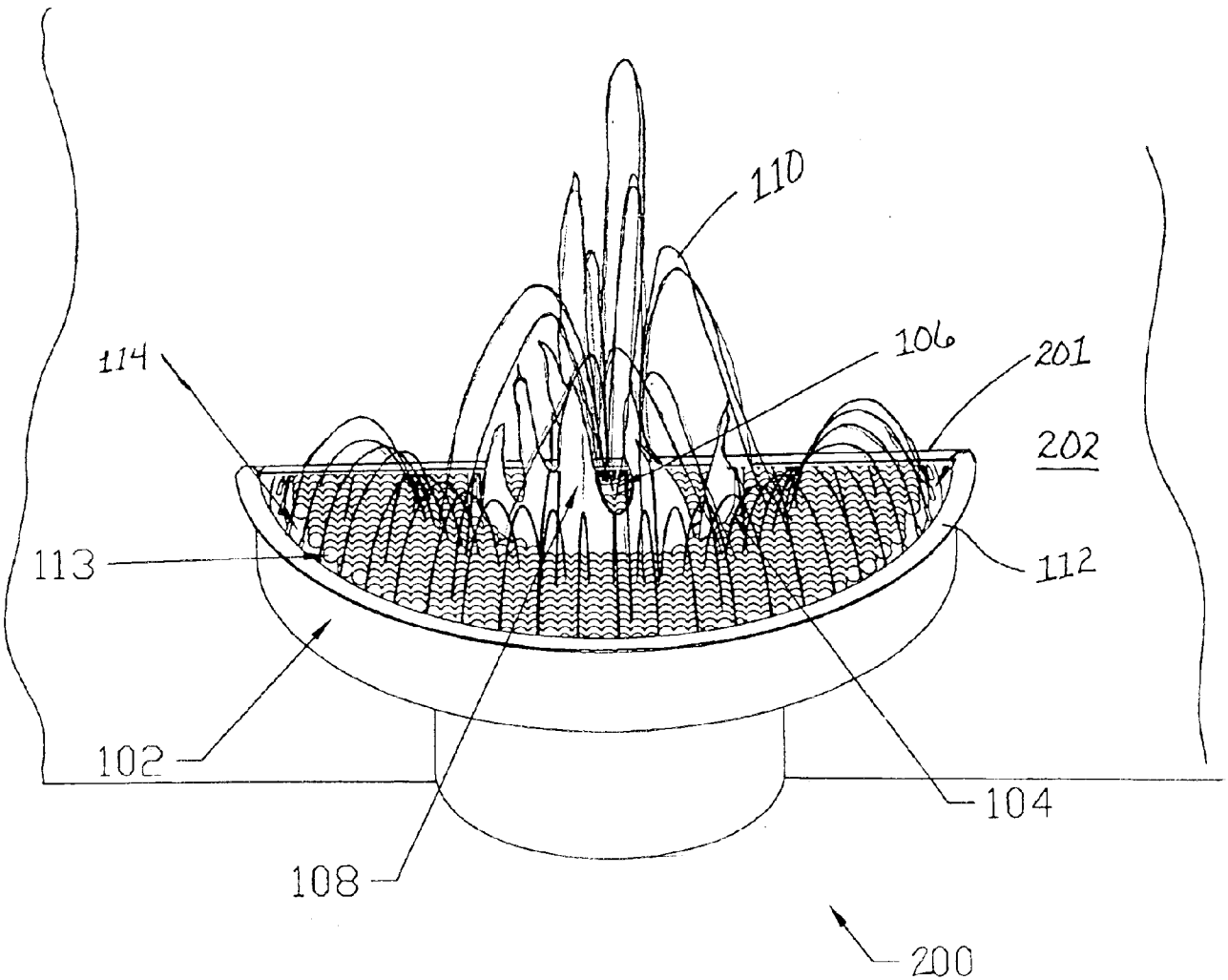
FIG. 7 is an isometric view of an alternate embodiment of the fire and water display device.

The fire and water display device 100 illustrated in FIGS. 1–5 has a generally circular overall shape. Alternate embodiments can have other shapes. As an example, one alternate embodiment illustrated in FIG. 7 provides a fire and water display device 200 having a semi-circular shape. The semi-circular display device 200 can be mounted so the flat side 201 mounts to a wall or support structure 202. The wall or support structure 202 can provide decorative elements that complement the display device 200. The gas distribution assembly 104, the water dispersion assembly 106, the grate assembly 114, and other components are substantially the same as described above except for the shapes.

As seen in FIG. 6, the water shield 154 is positioned to form a wall-like structure that helps direct the ignited gas flow from the apertures 150 radially toward the horizontal leg's free end portion 160 on the edge of the water shield. So, the flames 108 extend outwardly from under the water shield 154 before the flames turn and move upwardly. In the illustrated embodiment, the free end portion 160 of the water shield 154 is positioned generally radially inward of the apertures 150 in the inner gas conduit 118 to direct the flames generally toward the central water nozzle 124 (FIG. 3). The free end portion 160 is positioned generally radially outward of the apertures 150 in the outer gas conduit 120 to direct the flames generally toward the outer water dispersion assembly 106 (FIG. 3). In the illustrated embodiment, an annular flame deflector 162 is connected to the water shield 154 and is spaced radially inward from the free end portion 160 of the water shield's free end portion. The flame deflector 162 forms a generally vertical wall that helps control the vertical erectness of the flames. The degree of flame erectness can be controlled by varying the horizontal distance between the apertures 150 and the flame deflector 162.

The free end portion 160 of the water shield's horizontal leg 158 shown in FIG. 6 includes, in this embodiment, an integral semi-cylindrical protrusion 164 having a convex upper surface 166 and a corresponding concave lower surface 168 that also serves to influence the characteristics of the resulting flames 108. The convex upper surface 166 aids in deflecting falling water away from the space between the water shield's horizontal leg 158 and gas conduits upper surface. Accordingly, the protrusion 164 helps keep water away from the area where the gas and air mix and where the mixture is ignited, thereby ensuring that the flames 108 (FIG. 2) are not extinguished by the water. The water shield 154 can be configured so the outer-most drip edge of the horizontal leg 158 extends beyond the edge surface of the gas conduit 146 to further ensure that neither the flames 108 (FIG. 1) nor the igniter 152 is effected by the streams of flowing water 110 (FIG. 2). In an alternate embodiment, the water shield 154 has a substantially flat horizontal leg 158 without the protrusion.

The above detailed descriptions of embodiments of the invention are not intended to be exhaustive or to limit the invention to the precise form disclosed. While specific embodiments of, and examples for, the invention are described above for illustrative purposes, various equivalent modifications are possible within the scope of the invention, as those skilled in the relevant art will recognize. For example, while one orientation of the elements for a fire and water display device 100 is given, alternative embodiments may include more or fewer elements in different configurations. Furthermore, the elements of the various embodiments can be combined to provide even further embodiments. These and other changes can be made to the invention in light of the detailed description.

In general, the terms used in the following claims should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms. For example, while only one aspect of the invention is recited as embodied in a computer-readable medium, other aspects may likewise be embodied in a computer-readable medium. Accordingly, the inventors reserve the right to add additional claims after filing the application to pursue such additional claim forms for other aspects of the invention.

We claim:

1. A water and fire display device connectable to a source of flammable gas and a source of water, the device comprising:

a gas distribution assembly having a gas conduit be connectable to the source of flammable gas, the gas conduit having a gas-distribution aperture sized so the flammable gas can exit the gas conduit for ignition to create a flame that extends upwardly away from the gas conduit, the gas distribution assembly having a water shield adjacent to the gas distribution aperture positioned to prevent the water from extinguishing the flame adjacent to the gas conduit;

a water dispersion assembly spaced apart from the gas distribution assembly and adapted to direct streams of water upwardly toward the flame; and a water reservoir coupled to the water dispersion assembly, and positioned to capture and retain water dispersed from the water dispersion assembly.

2. The water and fire display device of claim 1 wherein the gas distribution assembly is concentrically disposed around the water dispersion assembly.

3. The water and fire display device of claim 1, further comprising a flame deflector spaced apart from the water shield and positioned to direct the flame upwardly.

4. The water and fire display device of claim 1 wherein the gas distribution aperture is in a top portion of the gas distribution assembly, and the water shield is spaced apart from the gas distribution assembly's top portion to provide a gas-and-air mixing area prior to ignition to form the flame.

5. The water and fire display device of claim 1 wherein the water dispersion assembly and the gas distribution assembly are contained in the water reservoir.

6. The water and fire display device of claim 1 wherein the water dispersion assembly and the gas distribution assembly are substantially coplanar.

7. The water and fire display device of claim 1 wherein the gas distribution assembly is configured to direct the flame generally toward the water dispersion assembly and to a position above the reservoir, and the water dispersion assembly is configured to direct the streams of water upwardly in a trajectory intersecting the flame at a position over the water reservoir.

8. The water and fire display device of claim 1, further comprising an igniter coupled to the gas distribution assembly configured to ignite a gas-and-air mixture between the gas conduit and the water shield.

9. The water and fire display device of claim 1 wherein the water shield is configured to adjustably control the shape and direction of the flame.

10. The water and fire display device of claim 1, further comprising a pump configured to retrieve water from the water reservoir and transport the water through the water dispersion assembly.

11. The water and fire display device of claim 1 wherein the water shield has an arcuate portion generally above the gas conduit and a drip edge spaced away from the gas conduit at a position to direct water away from the gas conduit.

12. The water and fire display device of claim 1, further comprising a water level sensor, wherein the water level sensor maintains a water level in the reservoir below an upper surface of the gas conduit.

13. The water and fire display device of claim 1, further comprising a water temperature sensor.

14. The water and fire display device of claim 1, further comprising a gas control device configured to selectively control the characteristics of a gas-and-air mixture delivered to the gas conduit.

15. The water and fire display device of claim 1 wherein the water shield is adjustable relative to the gas distribution assembly to control characteristics of the flame.

16. The water and fire display device of claim 1 wherein the gas distribution assembly and the water dispersion assembly operate independent from each other.

17. A water and fire display device connectable to a source of flammable gas and a source of water, the device comprising:

a gas distribution assembly having a gas conduit be connectable to the source of flammable gas, the gas conduit having a gas-distribution aperture sized so the flammable gas can exit the gas conduit for ignition to create a flame that extends upwardly away from the gas conduit, the gas distribution assembly having a water shield adjacent to the gas distribution aperture positioned to prevent the water from extinguishing the flame adjacent to the gas conduit;

a water dispersion assembly spaced apart from the gas distribution assembly and adapted to direct streams of water upwardly toward the flame;

a water reservoir coupled to the water dispersion assembly, and positioned to capture and retain water dispersed from the water dispersion assembly; and a gas manifold having a chamber fluidly coupled to the gas conduit of a first gas distribution assembly and to the gas conduit of a second gas distribution assembly, the gas manifold configured for the transport of the flammable gas, and having at least one valve configured to direct the flammable gas in the gas manifold to the gas conduit of the first gas distribution assembly, the gas conduit of the second gas distribution assembly, or the gas conduit's of the first and second gas distribution assembly.

18. A water and fire display device connectable to a source of flammable gas and a source of water, the device comprising:

a gas distribution assembly having a gas conduit be connectable to the source of flammable gas, the gas conduit having a gas-distribution aperture sized so the flammable gas can exit the gas conduit for ignition to create a flame that extends upwardly away from the gas conduit, the gas distribution assembly having a water shield adjacent to the gas distribution aperture positioned to prevent the water from extinguishing the flame adjacent to the gas conduit, wherein the gas distribution assembly is a first gas distribution assembly having a ring shape disposed around the water dispersion assembly, and further comprising a second gas distribution assembly having a ring shape disposed around the first gas distribution assembly;

a water dispersion assembly spaced apart from the gas distribution assembly and adapted to direct streams of water upwardly toward the flame; and a water reservoir coupled to the water dispersion assembly, and positioned to capture and retain water dispersed from the water dispersion assembly.

19. The water and fire display device of claim 18 wherein the water dispersion assembly is a first water dispersion assembly, and further comprising a second water dispersion assembly having a ring shape disposed around the second gas distribution assembly.

20. The water and fire display device of claim 19 wherein the second water dispersion assembly is configured as a single source of water in the center of the reservoir having two or more spray nozzles.

21. The water and fire display device of claim 20, wherein the water dispersed from the first water dispersion assembly interacts with the flame from the second gas distribution assembly, and wherein the water dispersed from the second water dispersion assembly interacts with the flame from the first gas distribution assembly.

22. A fire and water display device, the fountain comprising:

a water reservoir;

a burner assembly in the water reservoir, the burner assembly having a gas conduit and a water shield, the gas conduit having a plurality of apertures for dispersing a flammable gas for ignition to a flame, the water shield being adjacent to the gas conduit creating a flame ignition space therebetween, the water shield positioned relative to the gas conduit to prevent water from entering the ignition space and extinguishing the flame, the burner assembly adapted to direct the flame to extend upwardly; and a water dispersion assembly spaced apart from the burner assembly and in fluid communication with the water reservoir, the water dispersion assembly having nozzles configured to direct streams of water upwardly, at least some of the streams of water being directed in a trajectory that intersects the flame at a position generally above the water reservoir.

23. The fire and water display device of claim 22, further comprising an igniter coupled to the gas conduit proximate to the flame ignition space to ignite the flammable gas forming the flame.

24. The fire and water display device of claim 22, further comprising a gas manifold fluidly coupled to the gas conduit, the gas manifold comprising a chamber configured for the distribution of the flammable gas and at least one valve configured to control the distribution of the flammable gas to the gas conduit.

25. The fire and water display device of claim 22 wherein the burner assembly is a first burner assembly having a ring shape interposed between two water dispersion assemblies, and further comprising a second burner assembly having a ring shape disposed around the first burner assembly and interposed between the two water dispersion assemblies.

26. The fire and water display device of claim 25 wherein a first of the two water dispersion assemblies is ring shaped and disposed around the second burner assembly.

27. The fire and water display device of claim 26 wherein a second of the two water dispersion assemblies is configured as a single source of water in the center of the reservoir having two or more spray nozzles.

28. The fire and water display device of claim 27 wherein the water dispersed from the first water dispersion assembly interacts with the flame from the second flame assembly, and wherein the water dispersed from the second water dispersion assembly interacts with the flame from the first burner assembly.

29. The fire and water display device of claim 22 wherein the water shield has a drip edge space away from the gas conduit at a position to direct water away from the gas conduit.

30. The fire and water display device of claim 22, further comprising a gas control device configured to selectively control the characteristics of a gas-and-air mixture delivered to the gas conduit.

31. The fire and water display device of claim 22 wherein the water shield is adjustable relative to the burner assembly to control the flame's characteristics.

32. The fire and water display device of claim 22 wherein the burner assembly and the water dispersion assembly operate independent from each other.

33. The fire and water display device of claim 22 wherein the water shield is spaced apart from the top portion of the gas conduit to provide a gas-and-air mixing area prior to ignition to form the flame.

34. The fire and water display device of claim 22 wherein the burner assembly and the water dispersion assembly are contained within the water reservoir.

35. The fire and water display device of claim 22 wherein the burner assembly and the water dispersion assembly are substantially coplanar.

36. The fire and water display device of claim 22 wherein the water reservoir is substantially circular.

37. The fire and water display device of claim 22 wherein the water reservoir is substantially semi-circular.

38. A fountain for displaying the interaction of fire and water, the fountain comprising:

a gas distribution assembly having a gas conduit, the gas conduit having a plurality of apertures in a top portion of the gas conduit sized so a flammable gas can exit the gas conduit into an ignition space for ignition to create a flame that extends upwardly away from the gas conduit;

a water shield adjacent to the plurality of apertures positioned to prevent water from entering the ignition space and extinguishing the flame that extends upwardly away from the gas conduit, wherein the water shield has an arcuate portion above the gas conduit and a drip edge spaced away from the gas conduit at a position to direct water away from the gas conduit;

a spacer provided between the water shield and the gas conduit to retain the water shield a selected distance from the gas conduit, and to provide a gas-and-air mixing area prior to ignition;

an igniter coupled to the gas conduit between the top portion of the gas conduit and the water shield in proximity to the plurality of apertures configured to ignite a gas-and-air mixture;

a water dispersion assembly spaced apart from the gas distribution assembly and adapted to direct streams of water upwardly in a trajectory intersecting the flame, wherein the water dispersion assembly is disposed within the gas distribution assembly;

a water reservoir coupled to the water dispersion assembly and positioned to capture and retain water dispersed from the water dispersion assembly; and a pump fluidly coupled to the water dispersion assembly and to the water reservoir, the pump configured to direct water from the water reservoir to the water dispersion assembly.

* * * * *